United States Patent [19]

Kondo

[11] 4,208,938

[45] Jun. 24, 1980

[54] RANDOM RHYTHM PATTERN GENERATOR

[75] Inventor: Yoh-ichi Kondo, Kokubunji, Japan

[73] Assignee: Kabushiki Kaisha Kawai Gakki Seisakusho, Hamamatsu, Japan

[21] Appl. No.: 962,730

[22] Filed: Nov. 21, 1978

[30] Foreign Application Priority Data

| | | | |
|---|---|---|---|
| Dec. 8, 1977 | [JP] | Japan | 52-147387 |
| Dec. 8, 1977 | [JP] | Japan | 52-147388 |
| Dec. 8, 1977 | [JP] | Japan | 52-147389 |
| Jan. 11, 1978 | [JP] | Japan | 53-1707 |

[51] Int. Cl.[2] ..... G10H 1/00

[52] U.S. Cl. ..... 84/1.03; 84/1.24; 84/DIG. 12

[58] Field of Search ..... 84/1.03, 1.24, DIG. 12

[56] References Cited

U.S. PATENT DOCUMENTS

| | | | |
|---|---|---|---|
| 3,358,068 | 12/1967 | Campbell | 84/1.03 |
| 3,760,088 | 9/1973 | Nakada | 84/1.03 |
| 3,811,003 | 5/1974 | Harris | 84/1.03 |
| 3,958,483 | 5/1976 | Borrevik et al. | 84/DIG. 12 |
| 3,972,258 | 8/1976 | Adachi | 84/1.03 |
| 3,974,729 | 8/1976 | Koike | 84/1.03 |
| 4,163,407 | 8/1979 | Solender | 84/1.24 |

OTHER PUBLICATIONS

Word, Electronic Music Circuit Guidebook, 1975, p. 117.

*Primary Examiner*—Gene Z. Rubinson
*Assistant Examiner*—Forester W. Isen
*Attorney, Agent, or Firm*—Sughrue, Rothwell, Mion, Zinn and Macpeak

[57] ABSTRACT

Random rhythm-pattern generators have been proposed that can select one of several rhythm-patterns (i.e. pulse trains with different repetition cycles) prepared beforehand, change their playing order, and if necessary change the kind of instrumental musical sounds whenever the beating reaches a predetermined number, in order to produce a random accompaniment rhythm sound. The prior art rhythm-pattern generators played the rhythm-patterns only in a fixed order. Therefore, they had the disadvantage of providing a musical performance which was monotonous. According to this invention, this monotony of performance can be avoided because of the following construction: a random pulse generator supplies output pulses representing plural bits of a binary number to a decoder that in turn supplies an output pulse randomly to designate one of the pulse trains with different repetition cycles. Because of this construction, the order of rhythm-patterns to be played and, if necessary, the kind of musical instruments to be played can also be changed at random.

Since the designated pulse train or trains last during the period determined by the output pulse of a frequency divider, or the period corresponding to a desired beat number, no unnatural sound is produced when the random pattern is changed.

10 Claims, 7 Drawing Figures

RANDOM NOISE GENERATOR
1
20
COUNTER
2
3
3-1
3-2
3-3
D C Q
DECODER
1 2 3 4 5 6 7 8
A1
A2
A3
A4
A5
A6
A7
A8
O3
7 GATE CIRCUIT
FREQUENCY DIVIDER
6
CLOCK PULSE GENERATOR
5
11 SOUND SOURCE SELECTION CIRCUIT
11-1
11-2
11-3
8-1 SOUND SOURCE CIRCUIT
8-2 SOUND SOURCE CIRCUIT
9
10

RANDOM RHYTHM PATTERN GENERATOR

THE FIELD OF THE INVENTION

This invention relates to an apparatus that can execute random selection and generation of one of the rhythm-patterns (pulse trains with different repetition cycles) prepared beforehand whenever a predetermined number of beating is reached.

The conventional electronic musical instrument is usually equipped with a rhythm generator that can memorize different kinds of rhythm-patterns, but it can reproduce them only in a predetermined sequence whenever the beating reaches a predetermined number. Therefore, it has the disadvantage that the whole rhythm is the repetition of some patterns, and monotonous performance results. To avoid this monotony, it is proposed to provide variation rhythm-patterns for a particular rhythm or rhythms, and to properly change the variation pattern in playing. However, it is seen that even the proper changing of pattern is inferior to ad-lib playing because of the limited number of the variation rhythm-patterns memorized.

SUMMARY OF THE INVENTION

An object of this invention is to provide an apparatus that can make a random selection and generation of one of the pulse trains with different repetition cycles prepared beforehand whenever the beating reaches a predetermined number.

Another object of this invention is to provide a random rhythm-pattern generator that can select one of the pulse trains with different repetition cycles at random and also change the irregularity of selection.

A further object of this invention is to provide a random rhythm-pattern generator that can irregularly change the sorts or types of instrumental musical sound.

DETAILED DESCRIPTION OF THE INVENTION

The embodiments of this invention will be explained below referring to accompanying drawings.

Figure 1:
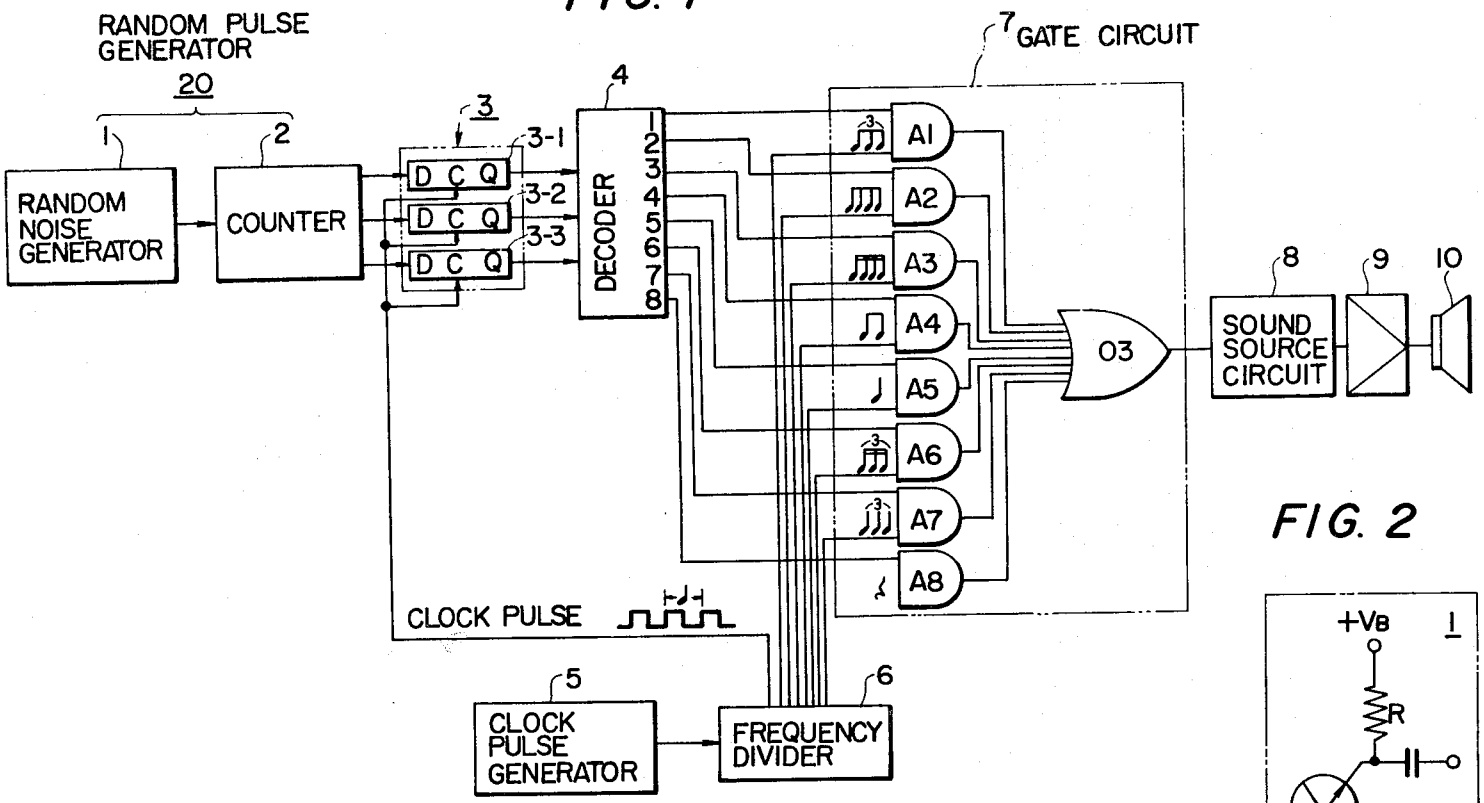
FIG. 1 is a block diagram of a first embodiment of this invention.

In the block diagram of FIG. 1, the block denoted by 1 is a random noise generator. Block 2 is a counter, which counts the output pulses from the random noise generator 1 in order to generate random pulses, forming a pulse generator 20 together with the noise generator 1. Block 3 is a condition selecting circuit provided with three delay type flip-flops 3-1, 3-2 and 3-3, for example, as shown in the figure. Block 4 is a decoder, 5 is a clock pulse generator, 6 is a frequency divider of clock pulses, 7 is a gate circuit, 8 is a sound source circuit for generating a single sort of instrumental musical sound, 9 is an amplifier, and 10 is a loudspeaker.

Figure 2:
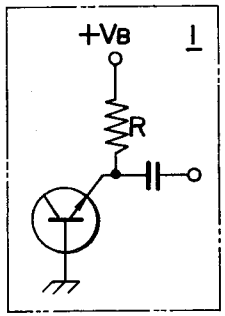
FIG. 2 is an example of random noise generator of FIG. 1.

The random noise generator 1, for example as shown in FIG. 2, consists of a transistor with reversely biased base-emitter and floating collector. The random noise generator 1 generates a white noise which has a random repetition cycle and includes almost all frequency components the in audible frequency band. This noise is fed to a three-bit binary counter 2, for example. The counter 2 counts the incoming noise pulses that exceed the threshold level of its internal logical circuit. As the input signal of the counter 2 is a white noise, the number of the incoming noise pulses easily reaches more than some dozens per second. The counter has three stages each representing a bit of binary number. Therefore, the number of the input pulses is expressed by a combination of 'H' and 'L' appearing at the outputs of those stages. Since the time interval between two nosie pulses that are generated at the noise pulse generator and exceed the threshold level is indefinite, the changes of the outputs of the counter from 'H' to 'L', or vice versa, occur at random. That means, if the 'H' and 'L' are related to the existence and absence of pulse, respectively, the combination of said random noise generator 1 and counter 2 forms a random pulse generator 20 that generates pulses with their random generation time. Other than this combination, it is possible to use a combination of shift registers and a clock pulse source as the pulse oscillator.

The condition selecting circuit 3 receives said irregular pulses and clock pulses having a predetermined repetition cycle (e.g., corresponding to a beat of rhythm). The following shows the dynamic characteristics of the delay type flip-flop circuit used as the condition selecting circuit 3: i.e., the output Q of the condition selecting circuit becomes 'H' when the clock pulse fed from the frequency divider 6 to the terminal C rises under the condition that the pulse supplied from the counter 2 to the terminal D is 'H'; and then it becomes 'L' when the clock pulse rises under the condition 'L' of the irregular pulse. Consequently, the turning of the flip-flop of the condition selecting circuit is timed by the clock pulses from the frequency divider, while the output of the counter 2 let the output of each flip-flop become either 'L' or 'H'. A binary code consisting of the outputs Q of said three flip-flops 3-1 to 3-3 is applied to a decoder 4, which decodes the binary code to mark one of the output terminals 1 to 8. The marking of a terminal occurs strictly at random because of said random operation of the flip-flops. The frequency divider 6 supplies pulses with different repetition cycles to AND circuits A1 to A8 of the gate circuit 7. The repetition cycles of these pulses are shown in the form of musical notes written above the input line of each AND circuit. Each AND circuit carries out a logical operation corresponding output of decoder 4 and that of frequency divider 6, and the resultant logical product is fed through OR gate 03 to the sound source circuit 8. Therefore, during a predetermined period (e.g., a beat in the figure) the loudspeaker 10 randomly sounds a musical sound (e.g., sound of percussion instrument) produced in the sound source circuit 8 with the pulse train denoted by said form of musical notes according to the output of selected terminal of the decoder 4. The AND gate (A8) of the gate circuit 7 receives no pulse from the frequency divider 6, therefore providing a pause of rhythm.

Thus, the term, "rhythm-pattern", as used in this invention does not refer to one chosen out of several prepared or memorized rhythm-patterns whose variation is fixed, as in Rumba and Samba rhythms, but rather it refers to these pulse trains with different repetition cycles supplied by the frequency divider 6 to the inputs of the AND circuits A1–A8 of FIG. 1. In other words, the "random rhythm-pattern" of this invention is a signal or an instrumental musical sound generated according to the sequence of pulse train groups, i.e. a random combination of pulse trains.

Figure 3:
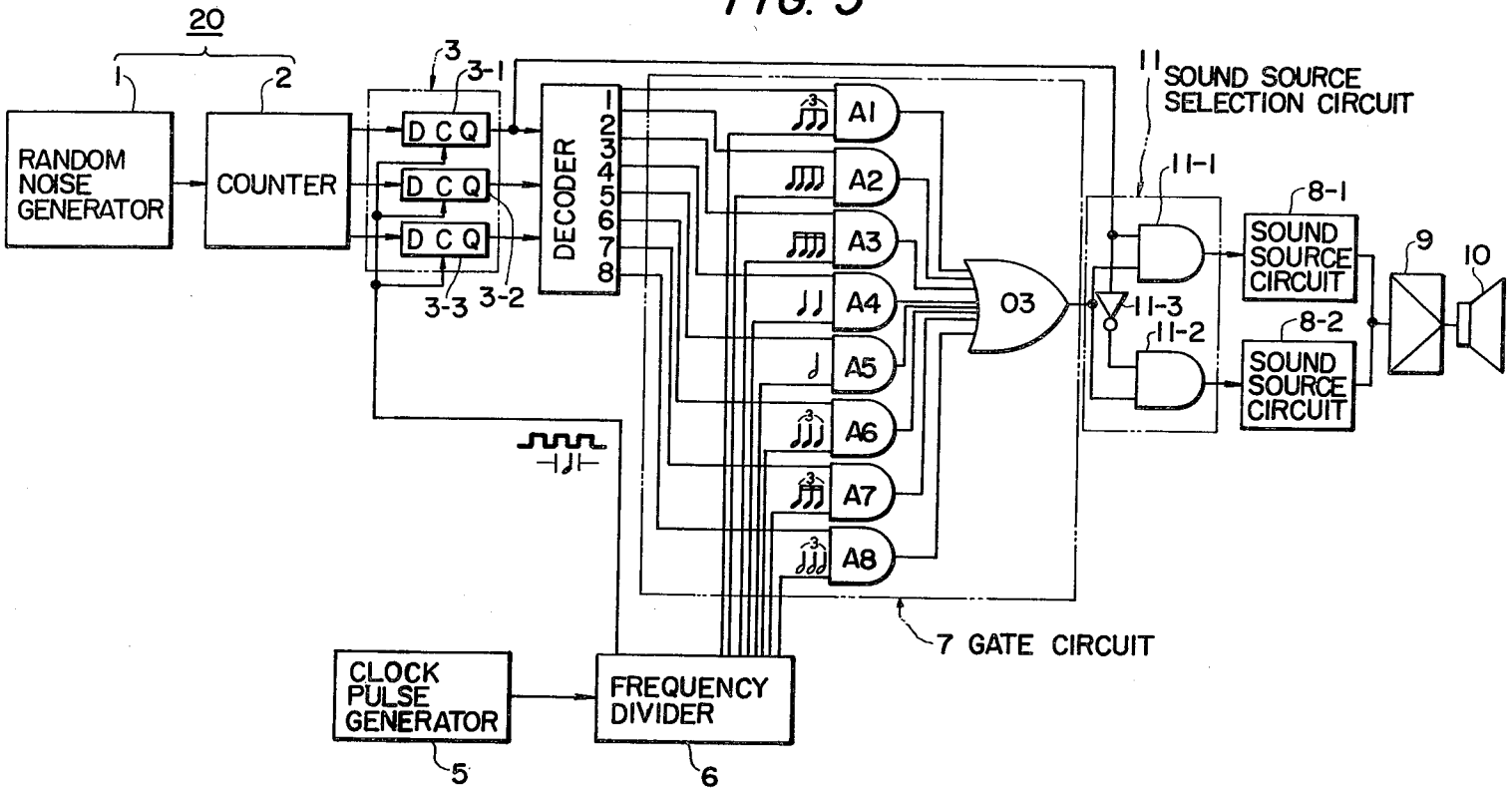
FIGS. 3 to 6 are block diagrams of a second to fifth embodiments of this invention.

FIG. 3 is a block diagram of a second embodiment of this invention, where the same or equivalent block is denoted by the same number as that of FIG. 1. A pair of sound source circuits 8-1 and 8-2 are provided. The sound source selection circuit 11 comprises two AND circuits 11-1, 11-2 and an inverter 11-3. The outputs of said AND circuits are applied to the sound source circuits 8-1 and 8-2, respectively. The circuits between the random noise generator 1 and the gate circuit 7 are the same as those of FIG. 1. The output of OR circuit 03 is simultaneously applied to one inputs of both AND gates 11-1 and 11-2 of sound source selection circuit 11. An output Q of a delay type flip-flop, e.g., 3-1, in the condition selecting circuit 3 is applied directly to the AND gate 11-1 and through an inverter 11-3 to the AND gate 11-2.

The output of said selected flip-flop 3-1 determines the sound source circuit 8-1 or 8-2 that should receive the signal from the gate circuit 7, or OR gate 03. Namely, output 'H' of the flip-flop 3-1 opens the AND gate 11-1, so that the signal from one of the AND gates A1 to A8 of gate circuit 7 selected by the output of decoder 4 is fed through OR gate 03 and AND gate 11-1 to the sound source circuit 8-1. It will be easy to understand that the output signal from said OR circuit 03 is applied to the sound source 8-2 when the flip-flop 3-1 gives the output 'L'. This means, if the sound source 8-1 is chosen to give the sound of hi-conga and the source 8-2 the sound of low-conga, for example, these instrumental musical sounds are chosen by turns with irregular timing, and therefore a variety of different random rhythm-patterns are produced.

Figure 4:
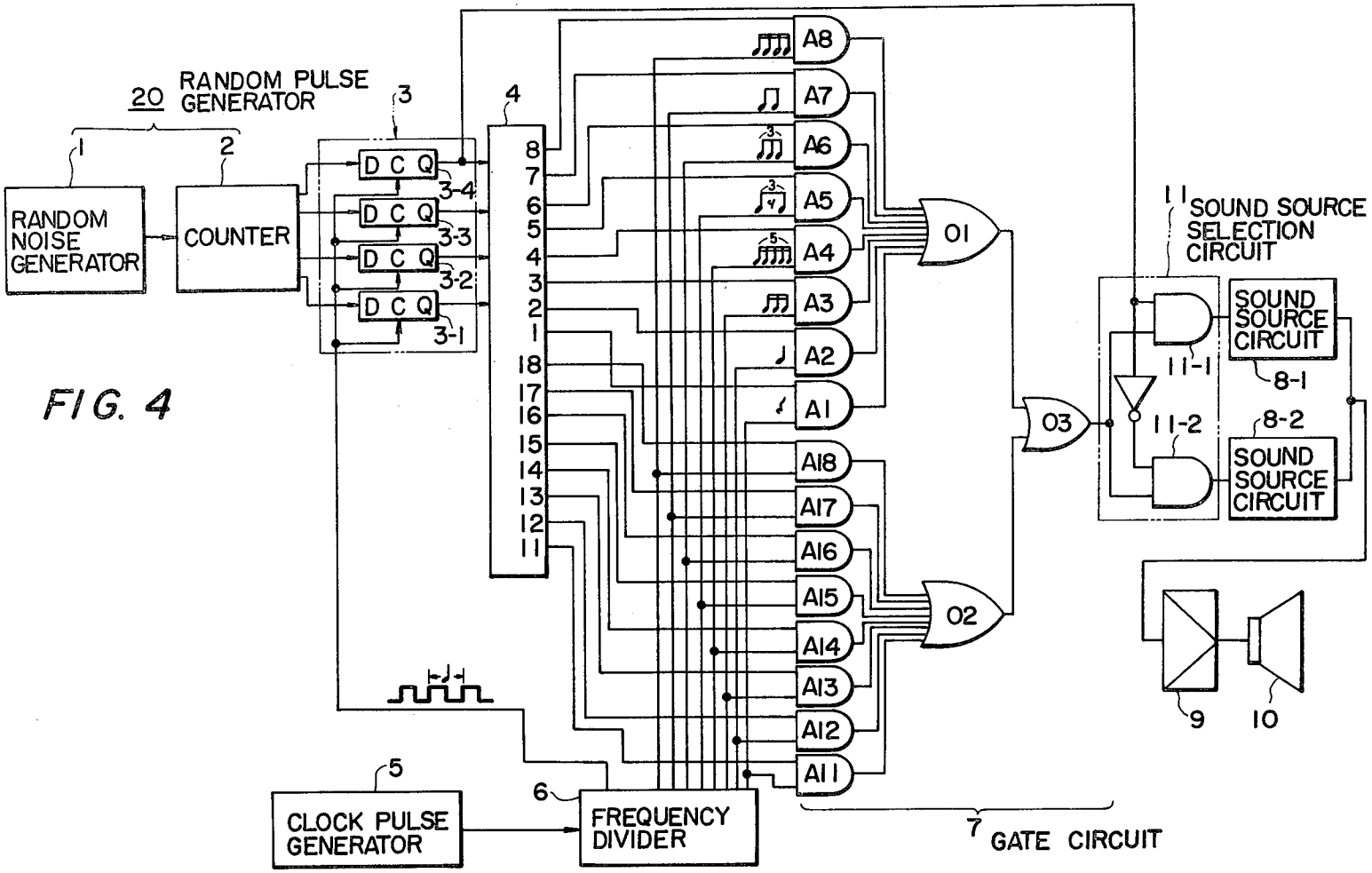

In the foregoing second embodiment, either of the sound source 8-1 or 8-2 is chosen depending upon the output condition of a flip-flop 3-1 of condition selecting circuit 3, therefore it has the disadvantage that the selecting operation will have a certain regularity in a long spell of performance. This disadvantage is eliminated in a third embodiment of FIG. 4. In the figure, the same number as that of FIG. 3 denotes the same or equivalent part. In contrast with the constitution illustrated in FIG. 3, in this embodiment the counter 2 has four output stages, the condition selecting circuit 3 has four flip-flops and the decoder 4 has four inputs. Accordingly, the decoder 4 has sixteen output terminals 1 to 8 and 11 to 18 as illustrated in the figure. Those output terminals are connected with one inputs of AND gates A1 to A8 and A11 to A18, respectively. To the other inputs of respective AND gates, pulse trains having various repetition cycles are fed from frequency divider 6 (in the figure, the cycle is expressed in the form of musical note). First inputs of AND gates A11 and A1 are respectively connected to the outputs 11 and 1 of the decoder 4, while their second inputs are connected to a common output of frequency divider 6. The other pairs of AND gates, e.g., A12 and A2, A13 and A3, etc., are also connected to their respective common output terminals of the divider 6. The output of each AND circuit is fed through OR gates 01, 02, and 03 to a sound source selection circuit 11, which receives the output from the flip-flop 3-4 forming MSB (the most significant bit) of the binary number represented by Q outputs of the flip-flops in the condition selecting circuit.

Consequently, the output 'L' of the MSB flip-flop 3-4 selects one of the AND gates A11 to A18 and its output 'H' selects one of the AND gates A1 to A8. Since the output of the flip-flop 3-4 varies from 'L' to 'H', or vice versa, irregularly in time in response to the pulses given by the random noise generation circuit 1, the selection of sound sources 8-1 or 8-2 by the sound source selection circuit 11 is at random, and the irregularity in the selection of sound sources, together with the irregularity of rhythm-pattern selection by the gate circuit 7, causes the loudspeaker 10 to sound an extremely irregular rhythm sound, making an excellent accompaniment effect.

Figure 5:
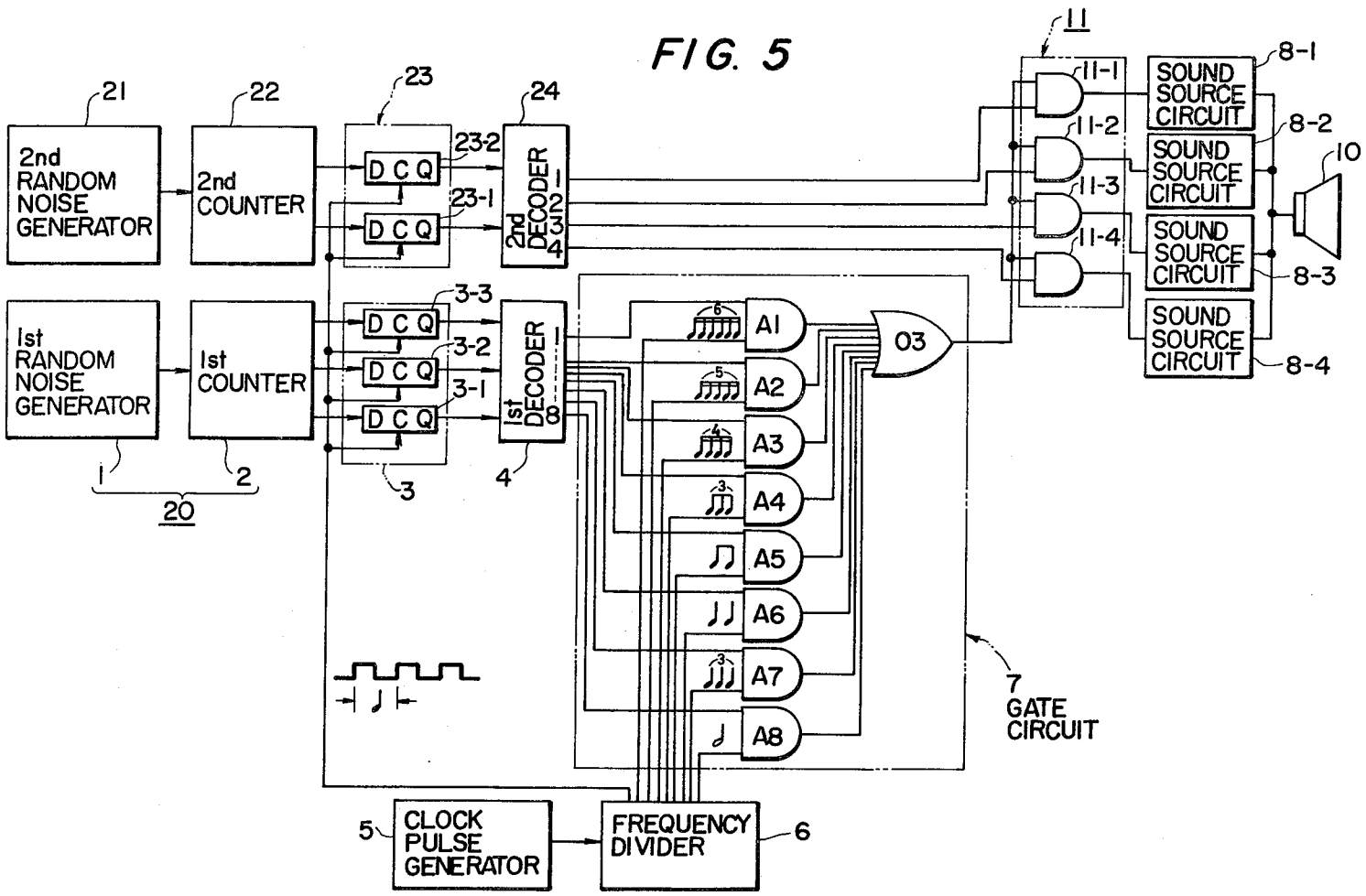

FIG. 5 is a block diagram of a fourth embodiment of this invention and the same number as that of FIGS. 1 and/or 3 denotes the identical part. Block 21 is a second random noise generator, 22 is a second counter, 23 is a second condition selecting circuit consisting of two delay type flip-flops 23-1 and 23-2, and 24 is a second decoder. The constitutions and operations of those units are exactly the same as the random noise generator 1, counter 2, condition selecting circuit 3 and the decoder 4 in FIG. 1, respectively. Namely, in the second decoder 24 one of the four terminals 1 to 4 is chosen to give an output. The selection of output terminal is made at random and is carried out whenever a predetermined number of beating is reached.

The sound source selection circuit 11 comprises four AND gates 11-1 to 11-4, outputs of which are fed to the sound source circuits 8-1 to 8-4, respectively. The output of gate circuit 7, or that of OR circuit 03, is supplied to the first inputs of all AND circuits 11-1 to 11-4 in the sound source selection circuit 11. The other inputs of the AND circuits are respectively fed from the outputs 1 to 4 of the second decoder 24. Therefore, in the sound selection circuit 11, only one of the AND gates is selected according to a logical product of two outputs from the first decoder 4 and the second decoder 24, both being generated at random. The output of the selected gate is fed to corresponding one of the sound source circuits 8-1 to 8-4. Therefore, the time sequence of the rhythm sounds sounded from the loudspeaker 10 is extremely irregular. Since the first and the second condition selecting circuits 3 and 23 operate under the control of a common clock pulse, each selected rhythm sound lasts during the time determined by the clock pulse (e.g., the length of a beat). And hence there is no such inconvenience that a sound source or a kind of musical instrument is replaced by another sound source or another kind of musical instrument in the period of one beat.

The reason why the second condition selecting circuit in this figure has two flip-flops is that four sound source circuits are utilized. The number, however, is not confined to this. It is apparent that the number of said flip-flops should be determined in accordance with number of sound source circuits prepared. The number of the flip-flops in the first condition selecting circuit 3 should also be determined according to the number of AND gates in the gate circuit 7, i.e., the number of pulse trains with different repetition cycles to be prepared.

The random rhythm-pattern generator of this invention can improve the effect of musical performance when used in combination with ordinary automatic accompaniment rhythm producing apparatus. In that case, it is preferable to provide common clock pulse generator and frequency divider for those apparatus in order to synchronize the beat of each rhythm sound with that of an ordinary automatic accompaniment rhythm producing apparatus.

Figure 6:
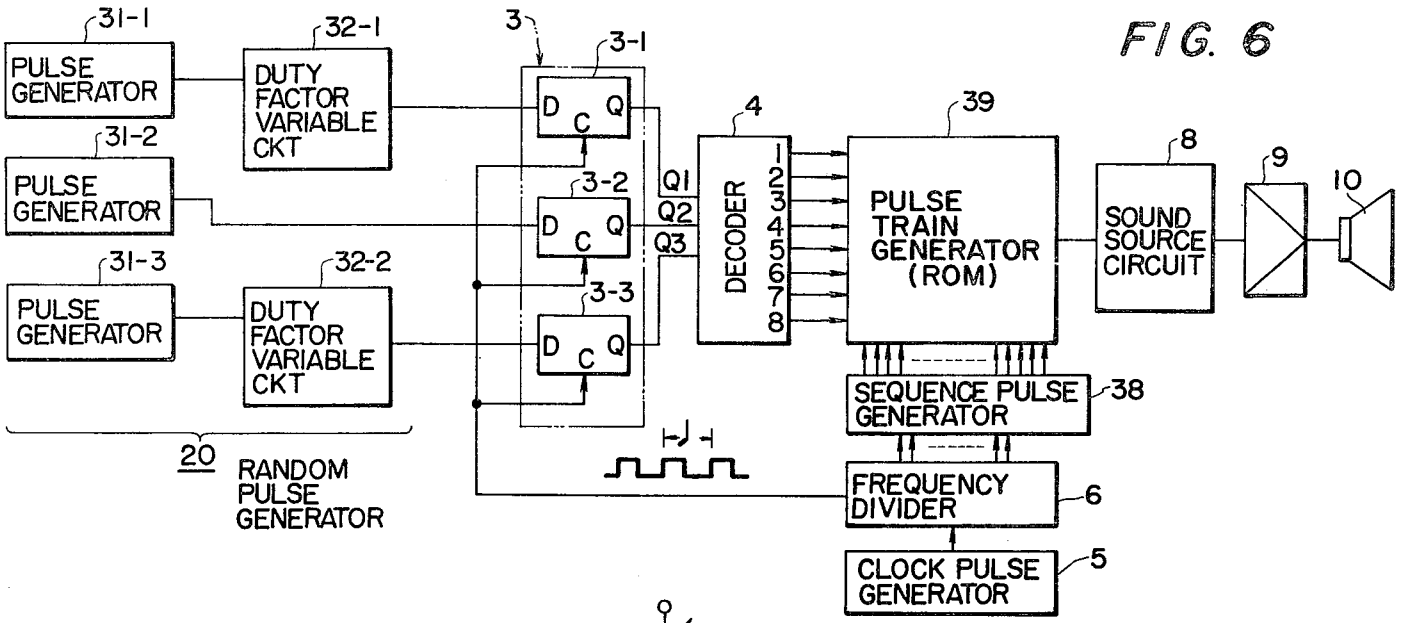

Next, explanation will be made on a fifth embodiment of this invention referring to FIG. 6. Blocks 31-1, 31-2, and 31-3 are pulse generators having oscillation frequencies different from each other and where the ratio of arbitral two frequencies never becomes an integer. Blocks 32-1 and 32-2 respectively fed with the output signals from the pulse generators 31-1 and 31-3 are the circuits for varying the duty factor and are usually of monostable multivibrators. In the circuit of FIG. 6, two of the three pulse generators are connected to the duty factor variable circuit, but generally it is sufficient to connect at least one of the pulse generators to the duty factor variable circuit. A combination of said pulse generator and duty factor variable circuit forms a random pulse generator 20. The parts denoted by the numbers 3 to 6 and 8 to 10 have the same constructions and functions as those of FIG. 1. Block 38 is a sequence pulse generator supplied with pulses from a frequency divider 6. Block 39 is a pulse train generator, for example provided with a ROM (read only memory) for memorizing a number of pulse trains with different repetition cycles. One of these pulse trains is read out at a time from the place addressed by both the output of the decoder 4 and that of the sequence pulse generator 38, and it is applied to the sound source circuit 8.

Figure 7:
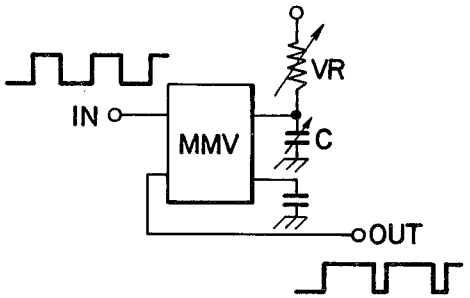
FIG. 7 is an example of the duty factor variable circuit of FIG. 6.

The pulse generators 31-1 and 31-3 are assumed to produce a series of pulses having duty factor of 50 percent, which are applied to monostable multivibrators 32-1 and 32-2 so as to increase the factor (e.g., up to 80 percent). The increase of the duty factor is achieved by adjusting a variable resistor VR and/or a variable capacitor C in order to regulate the duration time of the pulse taken out of the monostable multivibrator MMV, as shown in FIG. 7. In the figure, IN is the input terminal and OUT is the output terminal. The condition selecting circuits 3-1 to 3-3, being delay type flip-flops, have their output terminals Q that become 'H' at the moment the clock pulse from frequency divider 6 rises under the condition that the data inputs D are at their high level 'H'. When the data inputs are at their low level 'L', they are not reversed by the rise of the clock pulse. If the ratio of the pulse repetition cycle of each pulse generators 31-1 to 31-3 to that of the clock pulse is chosen not to be integer, it is almost impossible to predict the time when the data inputs from the random pulse generator 20 become 'H' because of their extreme irregularity. As the outputs of flip-flops 3-1 to 3-3 forming a plural bit binary code (here it is three bits), are fed to the decoder 4, one of the outputs 1 to 8 of the decoder 4 is selected at random. The pulse train generator 39, being addressed by a combination of the output from the decoder 4 selected in the foregoing manner and the pulse from the sequence pulse generator 38, reproduces one of the pulse trains stored in itself, or ROM, permitting the sound source circuit 8 to generate a corresponding musical sound, which is sounded from the loudspeaker 10 after passing through an amplifier 9.

Table 1 shows how the binary inputs are decoded at the decoder 4. Where, a binary number is represented by three bits. As is obvious from the table, when the LSB (least significant bit) Q1 is '0', the output number to be addressed is one of the odd numbers (1, 3, 5, 7), while when it is '1', the number is one of the even numbers (2, 4, 6, 8).

Table 1

| Q3 | Q2 | Q1 | Output No. |
|---|---|---|---|
| 0 | 0 | 0 | 1 |
| 0 | 0 | 1 | 2 |
| 0 | 1 | 0 | 3 |
| 0 | 1 | 1 | 4 |
| 1 | 0 | 0 | 5 |
| 1 | 0 | 1 | 6 |
| 1 | 1 | 0 | 7 |
| 1 | 1 | 1 | 8 |

If the MSB (most significant bit) Q3 of a binary code is '0', it designates one of the outputs 1 to 4, while if it is '1', it designates one of the outputs 5 to 8. Obviously, the probability of occurrence of '1' and '0' at the output of each flip-flop will be varied if the duty factors of the pulses applied to the data inputs of the delay type flip-flops 3-1 to 3-3 are varied. When the duty factor variable circuit 32-1 gives a pulse with its high level 'H' lasting longer that the low level 'L', one of said even number outputs is marked longer, and on the contrary when it gives a pulse with its level 'L' lasting longer than 'H', one of said odd number outputs is marked longer. If the duty factor variable circuit 32-2 is adjusted to give its high level 'H' for a long period under the condition that the circuit 32-1 has the high level 'H' lasting longer than the low level 'L', the probability of selecting either of output 6 or 8 becomes large.

In other words, if a sliding tap (Not shown in the figure) of the variable resistor VR is moved from one end through the center position to the other end in the duty factor variable circuit (FIG. 7), the lengths of 'H' and 'L' are varied and the pulse train selection mode is varied. That means, those pulse trains that are expected to be times reproduced more frequently are supposed to be stored in the pulse train generator 39 in connection with the output lines 6 and 8, then the sliding tap of the variable resistor VR must be positioned at a certain end in such manner as to provide a large factor in the duty factor variable circuits 32-1 and 32-2. Conversely, if the tap of the variable resistor is moved to the other end, the output line 2 or 4 is selected more frequently.

As is obvious from the above explanation, according to this invention a plurality of pulse trains with different repetition cycles and if necessary a plurality of instrumental musical sounds are easily produced by random selection whenever a predetermined number of beating is reached; therefore random rhythm patterns are easily produced and the effect of performance will be increased just like ad-lib playing. It is also easy to change the mode of the random selection of the random so the performance will be full of variety.

What we claim is:

1. A random rhythm-pattern generator comprising:

a clock pulse generator means for producing basic clock pulses, a frequency divider means for dividing the basic clock pulses, a random pulse generator means producing pulses with random repetition time, a condition selecting circuit means for generating an output of plural bits according to an output of the frequency divider means and pulses from the random pulse generator means, the switching of the state of the output condition of the condition selecting circuit means being timed by a pulse from said frequency divider means, and the output condition being determined by the output of the random pulse generator means, a decoder means, to which said plural bit output of the condition selecting circuit means is fed, for producing a different single decoded output for each different combination of plural bits, a means for selectively producing on its outputs different pulse trains with different repetition cycles according to respective combinations of an output of the decoder means and an output pulse from said frequency divider means, and sound source circuit means to which the outputs of said pulse train producing means are applied.

2. A random rhythm-pattern generator according to claim 1 wherein said sound source circuit means comprises a plurality of sound source circuits which generate respective sound different in pitch but identical in type of musical instruments, the outputs of said rhythm-pattern producing means being selectively applied to said sound source circuits, one at a time.

3. A random rhythm-pattern generator according to claim 1 or 2, wherein the random pulse generator means comprises a transistor with two electrodes reversely biased for random noise generation and a binary counter to which the noise generated in said transistor is applied.

4. A random rhythm-pattern generator comprising:

a clock pulse generator means for producing basic clock pulses, a frequency divider means for dividing the basic clock pulses, a random pulse generator means producing pulses with random repetition time, a condition selecting circuit means for generating an output of plural bits according to an output of the frequency divider means and pulses from the random pulse generator means, the switching of the state of the output condition of the condition selectng circuit means being timed by a pulse from said frequency divider, and the output condition being determined by the output of the random pulse generator means, decoder means, to which said plural bit output of the condition selecting circuit is fed, for producing a different single decoded output for each different combination of plural bits, gate circuit means for passing through one of the frequency divider output pulses, according to a logical operation of a decoded output of said decoder means and an output pulse of said frequency divider means, sound source selection circuit means for receiving the output of the gate circuit means and a particular bit output of the condition selecting circuit means and for carrying out a logical operation on them, said selection circuit means having a plurality of outputs only one of which is selected by each said logical operation, and a like plurality of sound source circuits respectively connected to the outputs of the selection circuit means so that only the sound source circuit connected to the selected output is selected.

5. A random rhythm-pattern generator according to claim 4, further comprising, a second random pulse generator means producing pulses with random repetition time, a second condition selecting circuit means to which an output pulse of said frequency divider means and random pulses from the second random pulse generator means are applied and which produces a plural bit output, the switching of the state of the output condition of which is timed by a pulse from said frequency divider means, and the output condition of which is determined by the output of the second random pulse generator means, and second decoder means supplied with the plural bit output from said second condition selecting circuit means, wherein the output of the second decoder means and that of said gate circuit means are fed to said sound source selection circuit means in which a logical operation on the two outputs is carried out to select only one of the outputs of said sound source selection circuit means.

6. A random rhythm-pattern generator according to claim 1, wherein the random pulse generator means consists of plural pulse oscillators and one or more duty factor variable circuits connected with at least one of said pulse oscillators, and the ratio of oscillation frequencies of any two oscillators never becomes an integer.

7. A random rhythm-pattern generator according to claim 1, wherein the pulse train producing means comprises a device for memorizing a number of pulse trains with different repetition cycles, and one of the pulse trains is read out from the place addressed by both of a set of output pulses of said frequency divider means and a selected output of said decoder.

8. A random rhythm-pattern generator comprising:

a clock pulse generator means for producing basic clock pulses, a frequency divider means for dividing the basic clock pulses, a random pulse generator means having two or more pulse oscillators at least one of which is connected to a duty factor variable circuit, a condition selecting circuit means for generating a plural bit output according to one of the outputs of the frequency divider means and to pulses from said random pulse generator means, a decoder to which said plural bit output of the condition selecting circuit means is fed, a pulse train producing means which memorizes a number of pulse trains with different repetition cycles of which is read out when a particular address is designed by both a set of output pulses of said frequency divider means and a selected output of said decoder, and a sound source circuit to which the output of said pulse train producing means is applied.

9. A random rhythm-pattern generator according to claim 8, wherein the two pulse generator means have their oscillation frequencies different from each other and the ratio of two arbitral frequencies never becomes an integer.

10. A random rhythm-pattern generator according to claim 1 or 2, wherein said pulse train producing means is a gate circuit containing plural AND gates and an OR gate, each AND gate has two input terminals, one of which is connected with one of the output terminals of the decoder means and the other one of the outputs of the frequency divider means, and the OR gate produces a logical sum of all the outputs of the AND gates.

* * * * *